US006143090A

United States Patent [19]

Lietz

[11] Patent Number: 6,143,090

[45] Date of Patent: Nov. 7, 2000

[54] METHOD AND DEVICE FOR DE-ICING AN INTAKE APERTURE

[75] Inventor: Dieter Lietz, Hannover, Germany

[73] Assignee: Wagner Alarm- und Sicherungssysteme GmbH, Langenhagen, Germany

[21] Appl. No.: 09/125,238

[22] PCT Filed: Feb. 13, 1997

[86] PCT No.: PCT/EP97/00683

§ 371 Date: Aug. 13, 1998

§ 102(e) Date: Aug. 13, 1998

[87] PCT Pub. No.: WO97/30428

PCT Pub. Date: Aug. 21, 1997

[30] Foreign Application Priority Data

Feb. 16, 1996 [DE] Germany ..... 196 05 842

[51] Int. Cl.[7] ..... B08B 5/00; B08B 9/00

[52] U.S. Cl. ..... 134/8; 134/22.1; 134/37; 134/42; 15/304; 340/582

[58] Field of Search ..... 134/8, 22.1, 22.11, 134/22.12, 37, 42; 15/304; 340/580, 582; 244/134 R, 134 A, 134 C

[56] References Cited

U.S. PATENT DOCUMENTS

| | | | |
|---|---|---|---|
| 3,765,842 | 10/1973 | Purt | 340/633 |
| 5,035,380 | 7/1991 | Weisend, Jr. et al. | 244/134 A |
| 5,314,145 | 5/1994 | Rauckhorst, III | 244/134 |
| 5,562,265 | 10/1996 | Rauckhorst, III | 244/134 R |

FOREIGN PATENT DOCUMENTS

| | | |
|---|---|---|
| 2136968 | 4/1980 | Germany . |
| 3348107 | 1/1988 | Germany . |

*Primary Examiner*—Randy Gulakowski
*Assistant Examiner*—Saeed Chaudhry
*Attorney, Agent, or Firm*—Volpe and Koenig, P.C.

[57] ABSTRACT

Disclosed is an apparatus and a method for de-icing an intake opening (2) in an intake duct (1) of a fire alarm system, through which ambient or equipment air is drawn in and supplied to a detector for sensing a fire parameter. To effectively remove an ice deposit on the intake opening (2) there is provided, in or on the intake opening (2), an elastic element having a through-hole (3) coaxial with the intake opening (2) which is adapted to be subjected to a compressed air blast in order to de-ice the intake opening (2) (FIGS. 4*a* to 4*c*).

10 Claims, 5 Drawing Sheets

METHOD AND DEVICE FOR DE-ICING AN INTAKE APERTURE

Figure 1A:
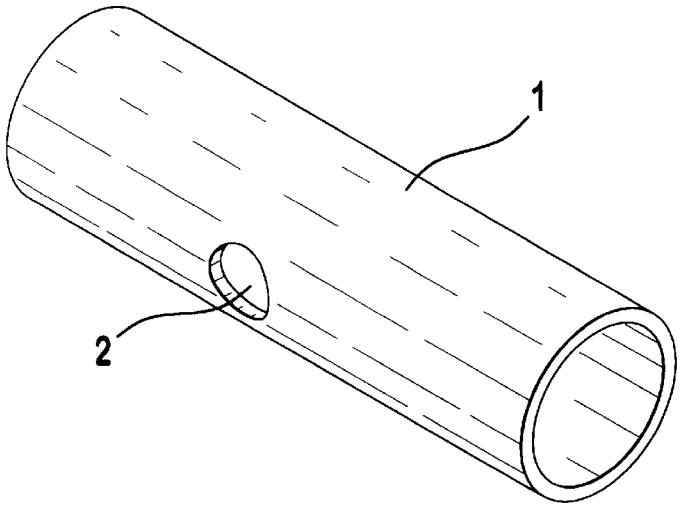

The present invention relates to apparatus and method for de-icing an intake opening in an intake duct of a fire alarm system through which ambient or equipment air is drawn in and fed to a detector for sensing a fire parameter.

Fire detection devices are also known, for example, under the technical term "equipment protection devices". Typical applications for fire detection devices are EDP equipment and especially individual components thereof, as well as similar electronic equipment such as, for example, measuring, control and regulating equipment, communication devices and related apparatus, and the like. The term "fire parameter" denotes physical values which undergo measurable changes in the vicinity of an incipient fire, e.g. the ambient temperature, the solid, liquid, or gaseous content of the ambient air (formation of smoke particles or aerosols, or steam) or the ambient radiation.

A fire detection device to which the present invention relates splits off a representative fraction of the equipment cooling air by means of a piping or ducting system, or actively draws in ambient or equipment air at predetermined locations and then feeds this representative fraction to the above-mentioned detector. For drawing-in the ambient or equipment air the intake pipes or ducts are provided with intake openings. Of course such a fire detection system is also needed in a refrigerated warehouse or refrigerated store room, if it is desired to detect a fire with high reliability even in the earliest stage of its development. An important prerequisite for this is that the fire detection device can continuously pull in a sufficient representative quantity of air and feed it to the detector. In refrigerated store rooms and refrigerated warehouses this needed continuity of air supply is imperiled through icing-up of the intake openings, and in other spaces or equipments through dirt accumulation.

From each of DE (German patent document) 21 36 968 B2 and DE (German patent document) 33 48 107 C2, there is known an air intake system for a fire detection device having plural intake pipes through which ambient or equipment air is drawn in via intake openings. In the system of DE 21 36 968 B2, cleansing of the intake openings takes place solely through compressed air. In the system of DE 33 48 107 C2 these are electrically heated in response to lessening through-flow of air in order to prevent icing-up of the intake openings. The disadvantage of this air intake system is that electrical leads need to be located in or at least on the intake pipes in order to supply the heating resistors. The electrical leads have the disadvantage that they are difficult to service, that if positioned in the intake pipes they can readily lead to fouling of the pipes through deposit of dust particles on the leads, and finally they are apt to interfere with sensitive electronic equipment through the relatively high heating currents and their accompanying electrical and electromagnetic fields.

In view of these disadvantages, it is an object of the present invention to provide an alternative solution for preventing the icing-up of intake openings of a fire detection device.

This object is achieved in accordance with the invention by the apparatus having the characteristics of claims 1 and 8 as well as by the method having the characteristics of claim 9.

The special advantages of the device according to the invention are that the elastic or flexible element can provide a de-icing apparatus which is easy to implement for the intake openings in an intake duct of a fire alarm system. To that end, the elastic element is attached to the intake duct in such a manner that it covers the intake opening which takes the form of a through-hole in the intake duct, so that the through-hole is positioned coaxially with that intake opening, whereby the diameter of the intake opening is reduced to the diameter of the through-hole in the elastic element. If an ice rim forms on the intake opening, an appropriate compressed air device delivers a compressed air blast through the intake duct, whereupon the elastic element is reversibly extended and deformed and breaks off the ice deposit. Furthermore, the flexible element is attached to the intake duct in such a manner that it covers the intake opening, except for a remaining through-hole which can, for example, also take the form of an annular slot. If a rim of ice forms on the intake opening, there again occurs the compressed air blast through the intake duct, whereupon the flexible element lifts up from the intake opening and delivers a mechanical impact to the edge of the intake opening during resilient return and thereby detaches the ice deposit. For the time being, the manner in which the flexible element delivers the mechanical impact to the intake opening or its edge shall remain undetermined. What is essential is only that a possible ice accumulation on the rim of the intake opening can be removed through the mechanical action of a flexible impact delivering element.

Finally, the method according to the invention provides an advantageous process for using a compressed air blast through the intake duct to stretch, or lift up from the intake opening an appropriately designed de-icing element, which subsequently, during subsidence of the compressed air blast and operation of a restoring force, suddenly contracts or springs back and, in so doing, detaches the ice accumulation from the intake opening. Here too, for the time being, the specific form of the de-icing element shall remain completely indeterminate. For example, a membrane of rubber or rubber-like material can be the previously described elastic element, or else a resilient tongue can be the previously described flexible element.

The need for delivering the compressed air blast is determined in all three embodiments by an airflow sensor of known kind, which is set to a predetermined desired value of the mass flow of the intake air. If the open cross-section of the intake opening is reduced through icing, the air through-flow lessens and the airflow sensor detects a system fault, as soon as the air mass flow falls below the threshold.

Advantageous specifics of the invention are defined in the dependent claims.

For construction and attachment of the elastic element to the intake duct three possibilities are contemplated: according to a first alternative the elastic element forms part of the intake duct itself. According to a second alternative, the elastic element forms part of a flexible collar which is clamped at least partway around the intake duct and, according to a third alternative, the elastic element consists of an elastic collar of rubber or rubber-like material which encircles the intake duct. The two latter alternatives have the advantage that retrofitting of the de-icing device is possible without difficulty by later attaching the collar to the intake duct.

Whereas the elastic element according to the second alternative is attached to the intake duct by a clamp latch, to attach the elastic collar according to the third alternative there is preferably provided a hole at one end and a nipple, or tab at the opposite end, the nipple being adapted to be pushed through the hole to fasten the elastic collar and to be held in place there. This is readily possible because the elastic collar takes the elongated form of a strap which can be stretched in its lengthwise direction by virtue of its elastic material when the nipple is pushed through the hole.

To enhance the durability of the elastic element it is contemplated that its through-hole has a reinforced edge which partially extends into the intake opening of the intake duct.

From the foregoing explanations it is apparent that, after application of the elastic or flexible collar, the intake opening consists essentially of the through-hole in the elastic element. Since the intake openings in an intake duct system can have different diameters depending on the applicable requirements, it is contemplated that the elastic elements are inventoried with different sizes of through-holes. This makes it possible to use intake ducts in the form of yard ware pipes with standardized intake openings, the desired diameter of the intake opening being provided by the de-icing collar. The different de-icing collars can also be made inexpensively because a single injection molding machine with different nozzles can be used.

In what follows, a preferred illustrative embodiment of the invention is described with reference to a drawing.

Figure 1B:
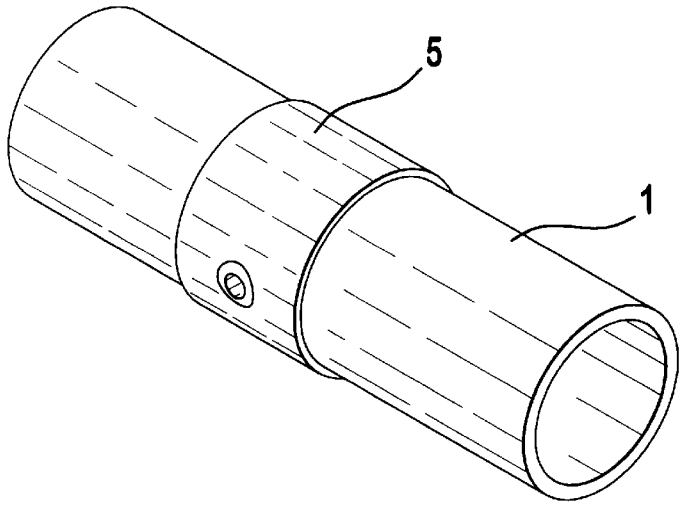
Figure 1C:
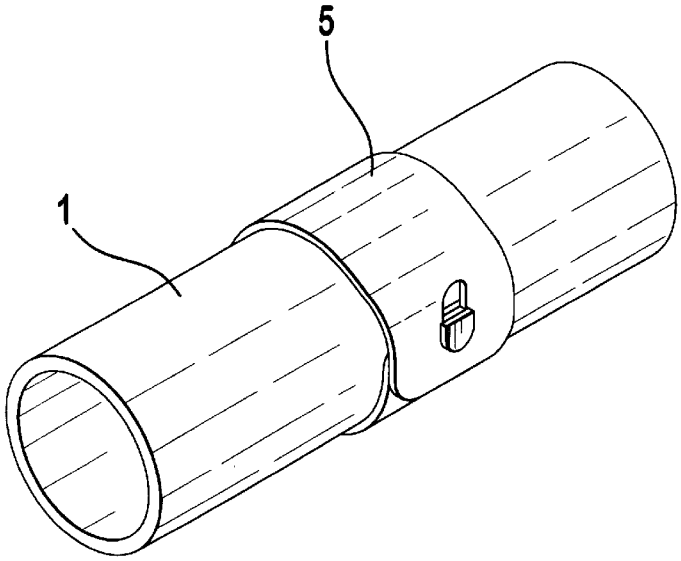
Figure 2:
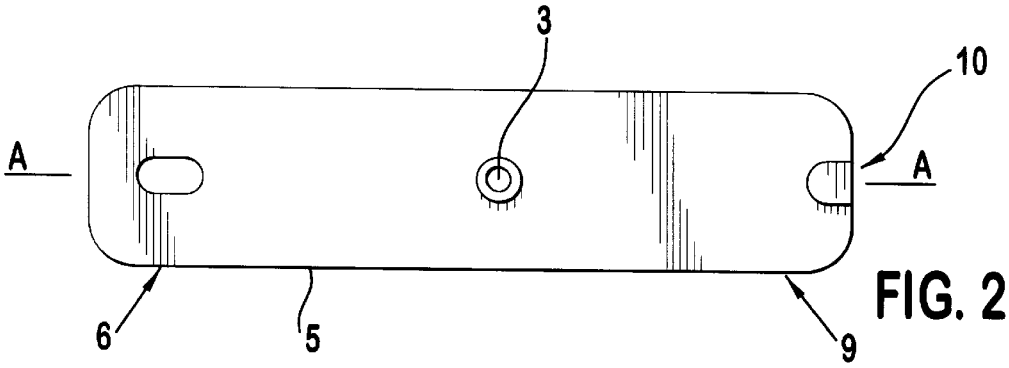

There is shown in:

FIGS. 1*a*–1*c* a perspective illustration of an intake duct cross-section, each of FIGS. 1*b* and 1*c* having an applied de-icing collar;

FIG. 2 a top view of the elastic de-icing collar according to FIGS. 1*b* and 1*c;*

Figure 3:
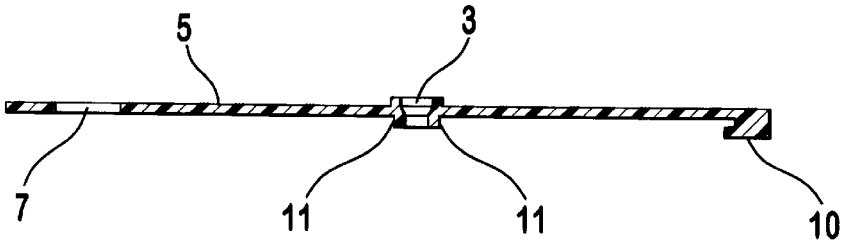
Figure 4A:
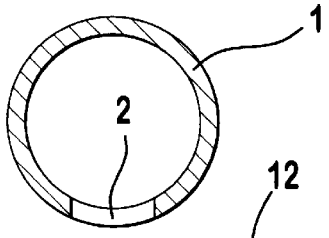
Figure 4B:
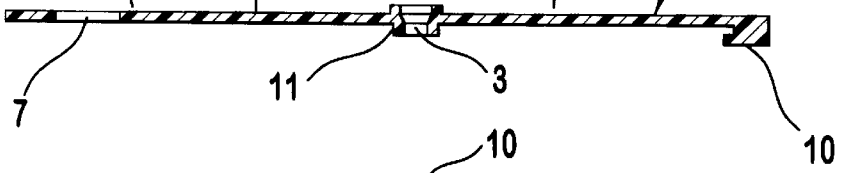
Figure 4C:
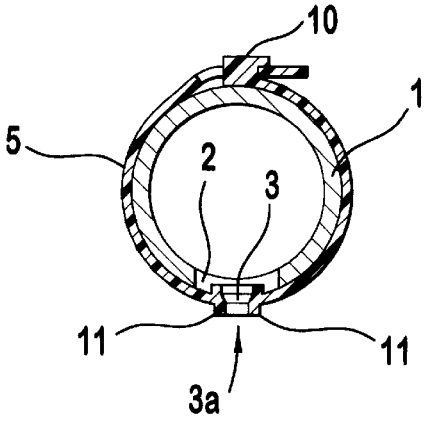
Figure 5:
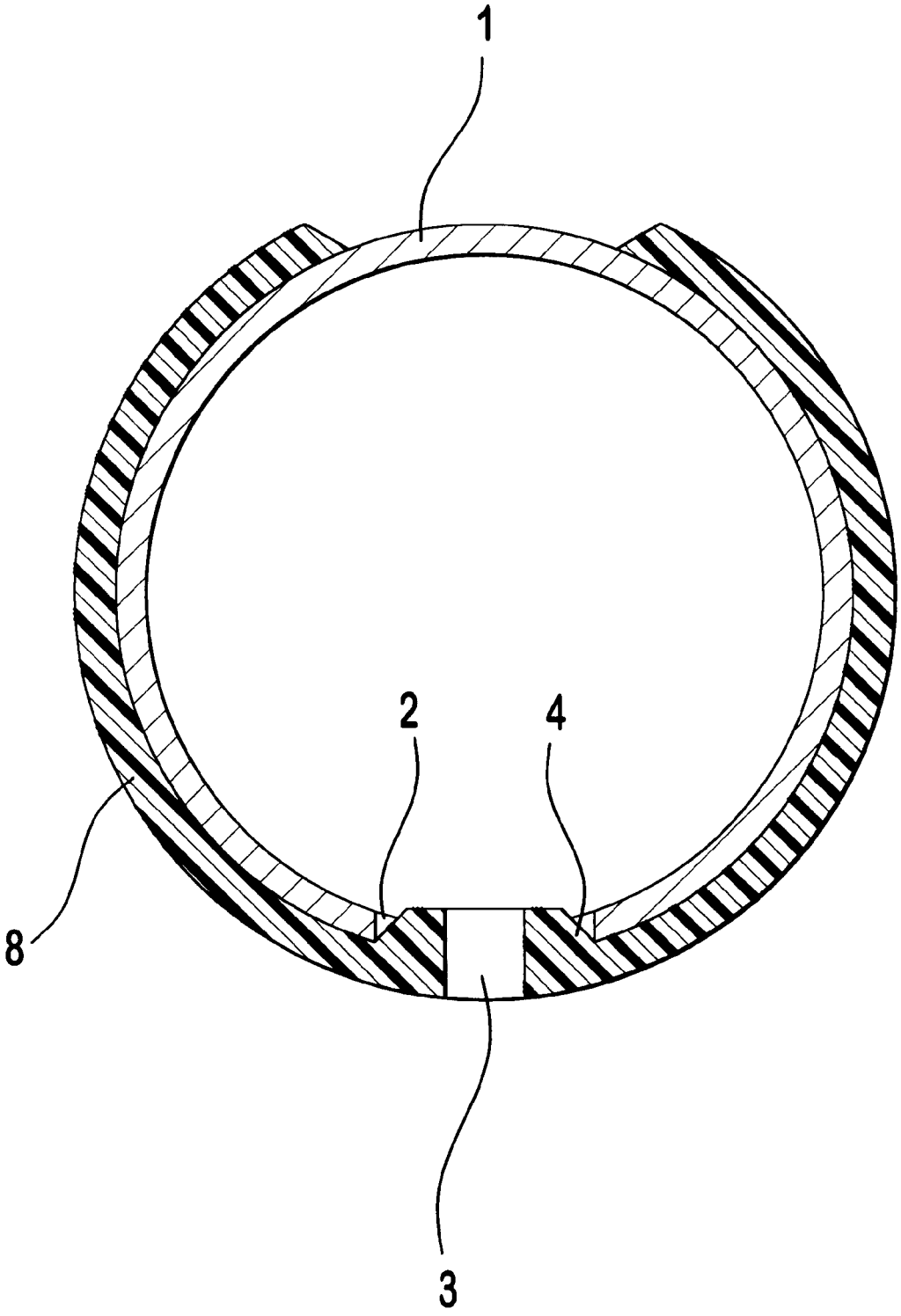
Figure 6:
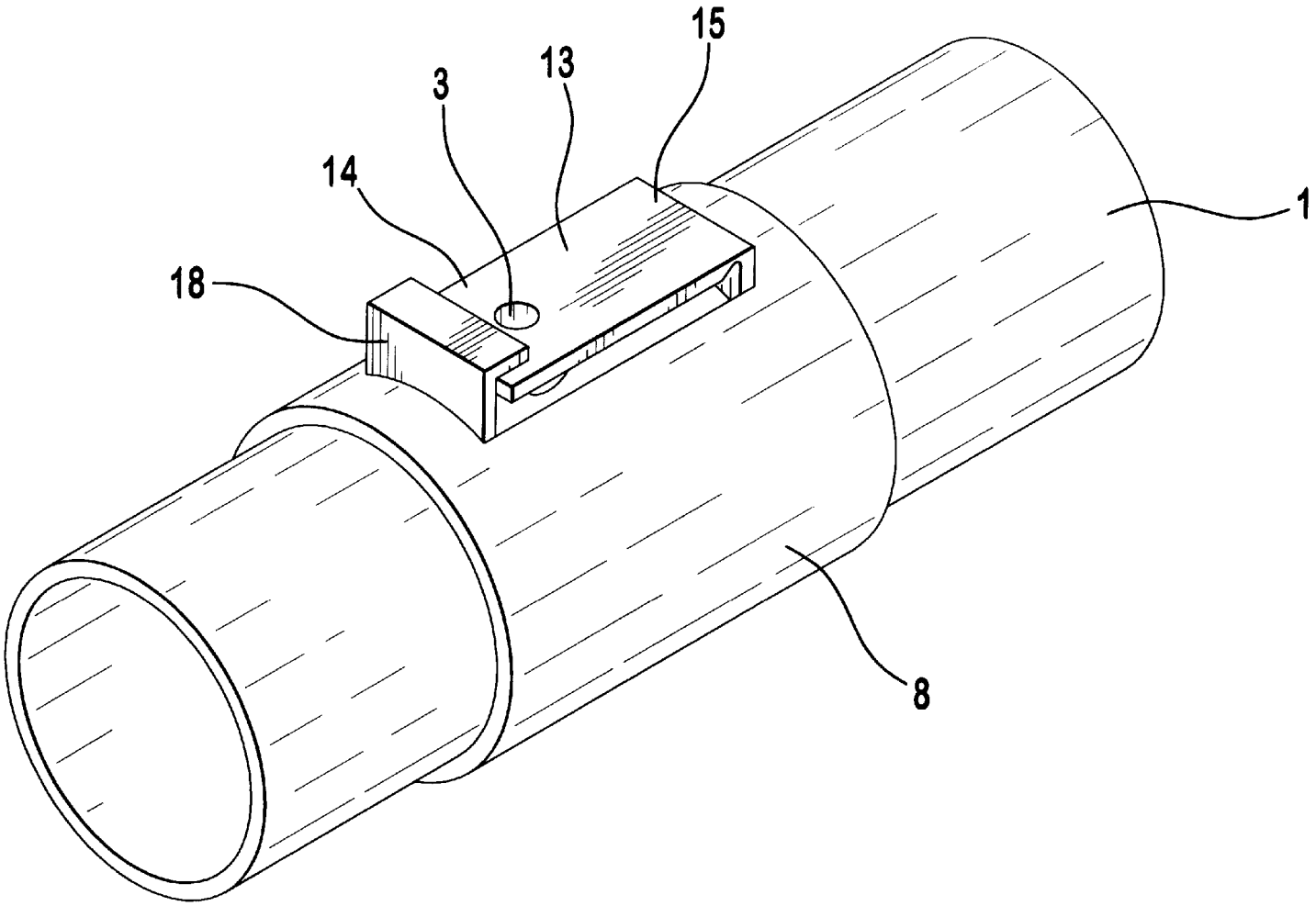
Figure 7:
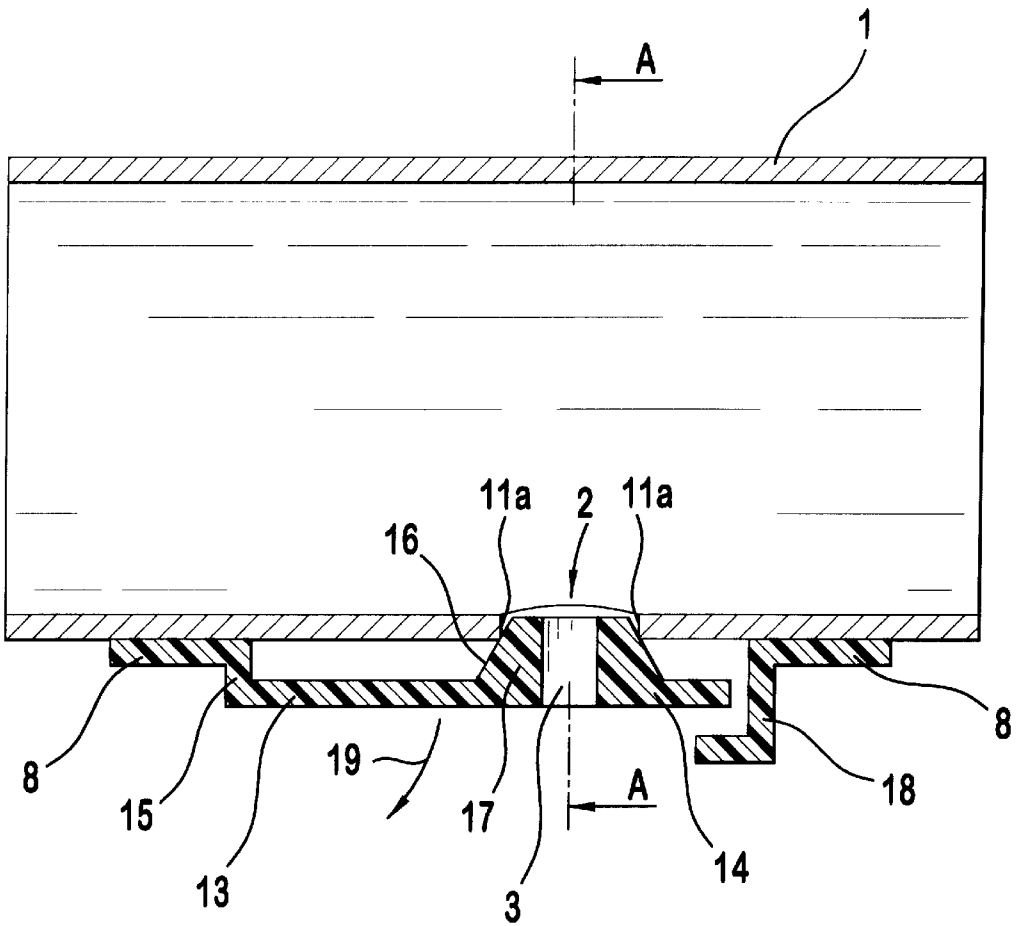
Figure 8:
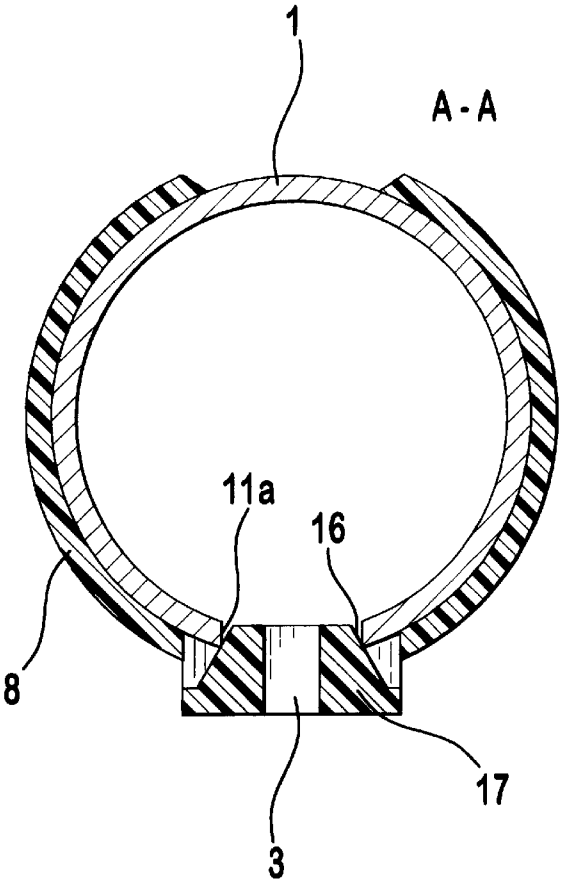

FIG. 3 a vertical cross-section through the elastic de-icing collar along line A—A of FIG. 2;

FIGS. 4*a*–4*c* the manner of attaching the elastic de-icing collar to a segment of intake duct;

FIG. 5 a cross-section through an intake duct segment, with clamped-on de-icing collar;

FIG. 6 another perspective illustration of an intake duct segment with an applied flexible de-icing collar and a flexible de-icing element;

FIG. 7 a lengthwise cross-section through the intake duct segment according to FIG. 6; and FIG. 8 a cross-section through the intake duct segment along line A—A of FIG. 7.

FIG. 1*a* is a perspective illustration of a segment of an intake duct 1 in the form of a cylindrical pipe. This pipe segment is part of a piping or duct system by means of which a representative fraction of the cooling air for equipment to be guarded, or the ambient air in a space to be guarded, is drawn in and supplied to a detector. For drawing in the ambient or equipment air the intake pipes or ducts are provided with intake openings 2, of which only one is shown here.

FIG. 1*b* shows the same perspective illustration of the pipe segment, but here surrounded by an elastic de-icing collar 5 at the location of intake opening 2. This de-icing collar 5 has a through-hole 3 (see FIG. 2), which, when the de-icing collar 5 is correctly positioned, is coaxial with the intake opening 2 and thus constitutes the intake opening 2.

FIG. 1*c* shows the reverse side of pipe segment 1 of FIG. 1*b* and illustrates how the elastic de-icing collar 5 is attached to the pipe segment 1. This is further described below with reference to FIGS. 3 to 4*c*.

FIG. 2 is a top view of the elastic de-icing collar 5 which has an elongated shape similar to a strap. It is made of rubber or rubber-like material or, for example, also of elastic plastic. In the middle there is provided the through-hole 3 which has previously been mentioned in relation to FIG. 1*b*, which is located coaxially with intake opening 2 when the elastic collar 5 is correctly positioned. At one end 6, the de-icing collar 5 has a slot 7 and on its opposite end 9 a tab 10 which, however, is better seen in FIG. 3.

FIG. 3 shows a vertical cross-section along line A—A through the elastic de-icing collar 5 of FIG. 2. In this illustration there can be seen the tab 10 attached to the top of de-icing collar 5 and made of the same material as the de-icing collar 5. It can further be seen from FIG. 3 that the through-hole 3 has a reinforced edge 11, which enhances the load bearing capacity and thereby also the durability of the de-icing collar 5.

FIGS. 4*a* to 4*c* show the manner of attaching the elastic de-icing collar 5 to the intake duct segment 1. Initially this has only the intake opening 2 in the form of a standard hole in pipe 1 (FIG. 4*a*). To apply the elastic de-icing collar 5 it is placed around the intake duct segment 1 so that the through-hole 3 of collar 5 engages the intake opening with its reinforced edge 11. The de-icing collar 5 is then wrapped around the pipe segment 1 so that the end 9 bearing tab 10 rests with its underside 12 directly on the outer surface of pipe segment 1, while the end 6 with slot 7 is pulled over tab 10 by stretching the de-icing collar 5 and is hooked onto the tab. This final state is illustrated in FIG. 4*c*. Of course, closing of the elastic de-icing collar around the reverse side from intake opening 2 can also be accomplished by Velcro®, or the like.

FIG. 5 shows a cross-section of an intake duct segment 1 having an intake opening 2 which is covered by a different embodiment of a collar. In this case, the elastic element 4, which contains the through-hole 3 and covers the intake opening 2 and thereby reduces it in practice to the through-hole 3, is part of a flexible collar 8 which is clamped almost completely around intake duct segment 1. In this case, the elastic element 4 also consists of elastic material so that it can respond in the desired manner to a compressed air blast.

The operation of the de-icing device is now described once again with reference to FIG. 4*c*. During operation of the fire alarm system, ambient or equipment air is continuously drawn into intake duct 1 through intake opening 2, or rather through-hole 3, in the direction of arrow 3*a*. If an ice deposit forms on the edge of through-hole 3, a compressed air blast is applied to intake duct 1, whereupon the elastic de-icing collar is reversibly stretched and deformed in the vicinity of the intake opening and the ice deposit is broken off.

FIG. 6 again shows a perspective illustration of a segment of an intake duct 1 corresponding to FIGS. 1*a* to 1*c*. In this embodiment, the collar 8 also consists of flexible material, as in the embodiment according to FIG. 5. To remove an ice deposit on the intake opening, there is provided here a flexible element 13 which is configured as a leaf spring and attached at its fixed end 15 to collar 8, while its free end 14 is pivotably positioned above intake opening 2. To prevent excessive deflection of flexible element 13, a stop 18 is provided. The collar 8, made of flexible material, is clamped around intake duct 1 and is made as a single unit with flexible element 13 and stop 18. Again, a through-hole 3 coaxial with intake opening 2 in intake pipe 1 is provided in flexible element 13, through which the ambient, or equipment air is drawn in, either exclusively or additionally.

FIG. 7 shows a cross-section through the intake duct 1 according to FIG. 6. From this illustration it can be seen that the freely pivotable end 14 of flexible element 13 has a plug 17, which is integral with flexible element 13 and narrows toward intake opening 2 in the form of a conic section. The position of the plug inside intake opening 2 represents the normal operating state of the fire alarm system, in which air is continuously drawn in through intake opening 2, or rather through a through-hole in plug 17, and fed to a detector (not shown). In this operating state the plug 17 partially engages the intake opening 2 and rests with its conical outer surface 16 against edge 11*a* of intake opening 2. As a result the air is drawn in exclusively through through-hole 3. However it is also possible to construct flexible element 13 with plug 17 in such a manner that, in operation, there still remains an annular slot between the conic outer surface 16 of plug 17 and the edge 11*a* of intake opening 2, through which ambient or equipment air can be drawn in, either in addition, or exclusively.

FIG. 8 shows a cross-section along line A—A of FIG. 7. From this illustration it is apparent that flexible collar 8 does not encircle intake duct segment 1 completely, but only partially, so that collar 8 can be readily applied to intake duct segment 1 transversely to its lengthwise direction. Thus, intake duct segment 1 and collar 8 form a clamp connection.

In what follows, the operation of this embodiment of the de-icing device is described once again, with reference to FIG. 7. During operation of the fire alarm system, ambient or equipment air is continuously drawn into intake duct 1 through intake opening 2, or rather through-hole 3. If an ice deposit forms on the edge 11 of through-hole 3, a compressed air blast is again applied to the intake duct 1, whereupon the plug 17 located at the free end 14 of flexible element 13 is deflected in the direction of arrow 19 and thereafter resiliently returned under the influence of the restoring force of flexible element 13, thereby applying a mechanical impact with its conical outer surface 16 against edge 11*a* of intake opening 2. Through this mechanical action, an ice deposit is reliably removed.

Of course, alternative embodiments of the de-icing element are possible. Their configuration is mainly determined by their reliability of operation and ease of attachment and not least by their manufacturing cost. It is important that the de-icing element be so constructed that it creates a response to the compressed air blast by which the ice deposit on the intake opening is detached.

What is claimed is:

1. Apparatus for de-icing an intake opening in an intake duct of a fire alarm system, through which ambient or equipment air is drawn in and fed to a detector for sensing a fire parameter, characterized in that in or on the intake opening there is provided an elastic or flexible element having a through-hole coaxial with intake opening, which is adapted to be subjected to a compressed air blast via the intake duct.

2. Apparatus according to claim 1, characterized in that the elastic element is part of the intake duct.

3. Apparatus according to claim 1, characterized in that the elastic element is part of a flexible collar which is clamped at least partially around intake duct.

4. Apparatus according to claim 1, characterized in that the elastic element is an elastic collar of rubber or rubber-like material which encircles intake duct.

5. Apparatus according to claim 4, characterized in that the elastic collar has a hole at one end and a tab at its opposite end and that the tab can be inserted through hole and there retained in order to attach the elastic collar.

6. Apparatus according to claim 1, characterized in that the through-hole has a reinforced edge which partially engages the intake opening of the intake duct.

7. Apparatus according to claim 1, characterized in that the elastic element is provided with through-holes of different sizes.

8. Apparatus according to claim 1, characterized in that the elastic or flexible element is arranged to exert a mechanical impact against the edge of intake opening.

9. A method for de-icing an intake opening in an intake duct of a fire alarm system, through which ambient or equipment air is drawn in and fed to a detector for sensing a fire parameter, characterized in that a compressed air blast is produced in the intake duct, by means of which an elastic or flexible de-icing element located in or on the intake opening is stretched or lifted up from the intake opening and subsequently resiliently returned under the influence of a restoring force, thereby detaching ice deposited on the intake opening.

10. The method of claim 9, characterized in that the de-icing element exerts a mechanical impact against the edge of the intake opening during its resilient return.

* * * * *